US010202917B1

(12) United States Patent
Hellstrom et al.

(10) Patent No.: US 10,202,917 B1
(45) Date of Patent: Feb. 12, 2019

(54) SYSTEM AND METHOD TO FILTER ENGINE SIGNALS

(71) Applicant: Ford Global Technologies, LLC, Dearborn, MI (US)

(72) Inventors: John Erik Mikael Hellstrom, Ann Arbor, MI (US); Amey Yogesh Karnik, Canton, MI (US); Adam Nathan Banker, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/727,474

(22) Filed: Oct. 6, 2017

(51) Int. Cl.
*F02D 41/04* (2006.01)
*F02D 41/26* (2006.01)
*F02D 41/00* (2006.01)

(52) U.S. Cl.
CPC ..... *F02D 41/0087* (2013.01); *F02D 41/04* (2013.01); *F02D 41/26* (2013.01); *F02D 2041/0012* (2013.01)

(58) Field of Classification Search
CPC ..... F02D 41/0087; F02D 41/04; F02D 41/26
USPC ..... 123/481, 325, 332, 198 F, 321, 322; 701/112
See application file for complete search history.

(56) References Cited

U.S. PATENT DOCUMENTS

| | | | | |
|---|---|---|---|---|
| 6,138,504 | A | 10/2000 | Lewis et al. | |
| 9,086,020 | B2 | 7/2015 | Pirjaberi et al. | |
| 9,494,088 | B1 | 11/2016 | Serrano et al. | |
| 2014/0041625 | A1* | 2/2014 | Pirjaberi | F02D 41/00 123/349 |
| 2015/0100221 | A1* | 4/2015 | Routledge | F01N 1/165 701/111 |
| 2016/0131058 | A1* | 5/2016 | Younkins | F02D 41/0087 123/334 |
| 2017/0342920 | A1* | 11/2017 | Pirjaberi | F02D 41/3058 |
| 2017/0370804 | A1* | 12/2017 | Chen | G01M 15/11 |

OTHER PUBLICATIONS

Karnik, Amey et al., "System and Method for Operation Engine Cylinders," U.S. Appl. No. 15/290,579, filed Oct. 11, 2016, 34 pages.

* cited by examiner

*Primary Examiner* — Mahmoud Gimie
(74) *Attorney, Agent, or Firm* — Julia Voutyras; McCoy Russell LLP

(57) ABSTRACT

Systems and methods for controlling an engine with cylinders that may be selectively activated and deactivated are presented. In one example, coefficients of a finite impulse response filter are adjusted responsive to changes in engine induction ratio so that undesirable frequencies output from engine sensors may be attenuated to improve engine control.

20 Claims, 5 Drawing Sheets

SYSTEM AND METHOD TO FILTER ENGINE SIGNALS

FIELD

The present description relates to a system and methods for improving operation of an engine that includes cylinders that may be selectively activated and deactivated to conserve fuel while meeting engine torque demands. The system and methods may be applied to an engine that deactivates engine cylinders by deactivating intake and exhaust valves of deactivated cylinders.

BACKGROUND AND SUMMARY

An engine control system may sense engine intake manifold pressure to determine engine operating parameters that are a basis for adjusting engine actuators. For example, engine intake manifold pressure may be sampled to determine engine intake manifold absolute pressure (MAP). The engine intake manifold pressure along with engine speed may be converted into an amount of air flowing through the engine using the ideal gas law. Once engine air flow is known, a desired amount of fuel that provides a desired engine air-fuel ratio may be determined by dividing the engine air flow rate by the desired engine air-fuel ratio. However, the engine intake manifold pressure may include frequencies that may cause intake manifold pressure to exhibit a standard deviation that is larger than desired. If the engine fuel amount were adjusted responsive to the raw (e.g., unfiltered) engine intake manifold pressure sampled at a slow rate and at fixed crankshaft intervals, the engine's air-fuel ratio may vary more than is desired.

One way to reduce engine air-fuel variation is to apply a first order low pass filter to a MAP signal and sample the MAP signal at a rate that is an integer multiple of engine firing frequency. The filtered MAP may then be used to determine an amount of fuel to inject to the engine. However, if the engine has a capacity to deactivate and reactivate individual cylinders such that the actual total number of active cylinders changes from engine cycle to engine cycle, processing the MAP sensor signal via a first order low pass filter and a constant sampling frequency may not provide a filtered MAP sensor signal that is suitable for controlling engine fuel injection because frequencies within the MAP sensor signal dynamically change while poles of the first order filter remain constant.

The inventors herein have recognized the above-mentioned issues and have developed an engine operating method, comprising: receiving a signal to a controller; adjusting coefficients of a finite impulse response filter responsive to an engine induction ratio (e.g., an actual total number of active cylinders in a cylinder cycle (cylinders that are combusting air and fuel) divided by the actual total number of engine cylinders); filtering the signal via the finite impulse response filter; and adjusting one or actuators responsive to the filtered signal.

By adjusting coefficients of a finite impulse response filter or an infinite impulse response filter responsive to engine induction ratio, it may be possible to provide the technical result of providing a filtered engine signal that has a desired level of dynamic response with a desired standard deviation even when an engine is operated with an induction ratio that is less than one. When an engine signal is filtered according to the present description, the filtered engine signal may have a desired standard deviation that allows engine air-fuel ratio to be tightly controlled. Further, other engine actuators, such as camshafts and intake throttles, may be more precisely controlled when the engine induction ratio changes or is a fractional value. The finite impulse response filter may be implemented via instructions in a controller so that modification of filter coefficients may be synchronized with cylinder mode changes.

The present description may provide several advantages. Specifically, the approach may improve engine air-fuel control. Further, the approach may be applied to a variety of different engines having different cylinder configurations. Further still, the approach may eliminate or reduce signal strength of frequencies of a signal that tend to increase a standard deviation of the signal so that actuators that are adjusted responsive to the signal may be smoothly controlled while providing a desired dynamic response.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
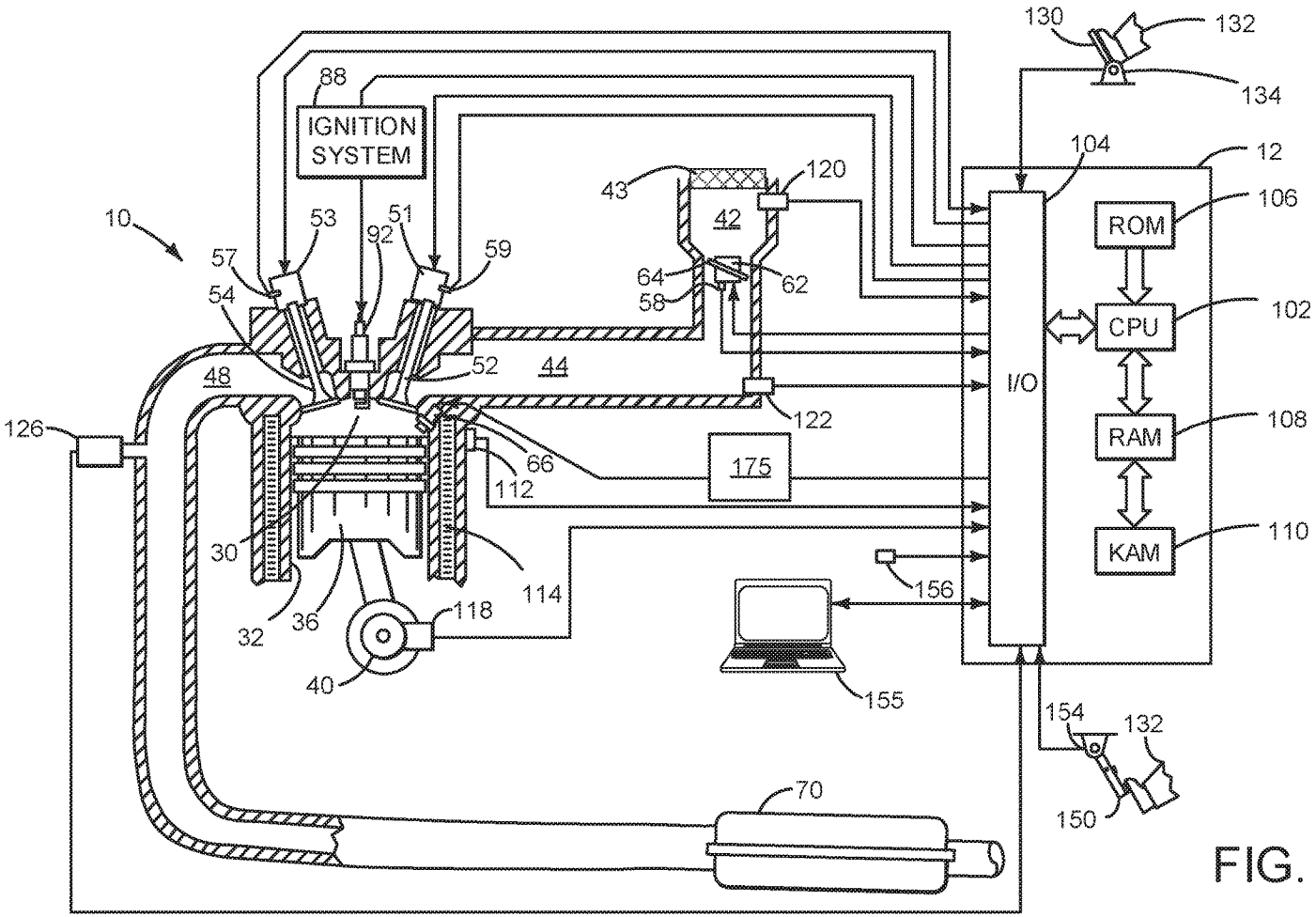
FIG. 1 is a schematic diagram of an engine.
Figure 2A:
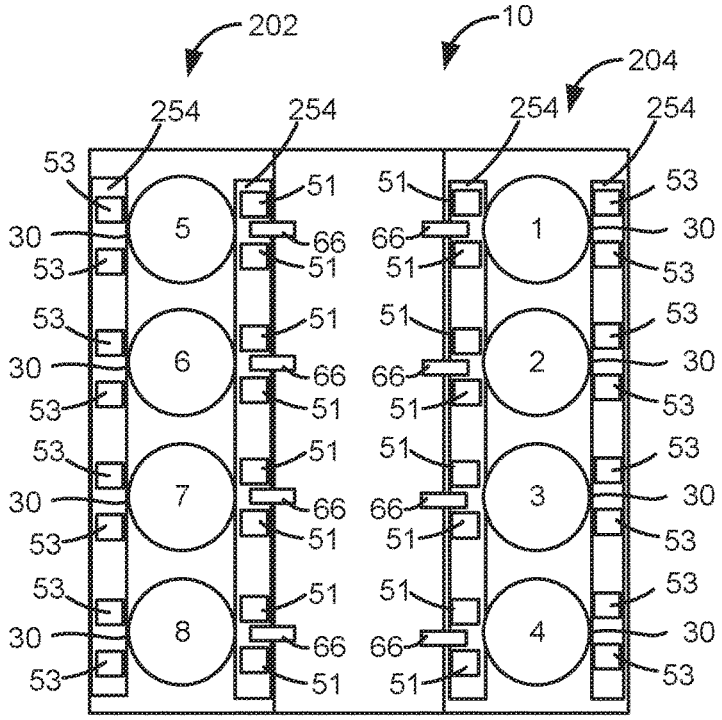
FIG. 2A is a schematic diagram of an eight cylinder engine with two cylinder banks.
Figure 2B:
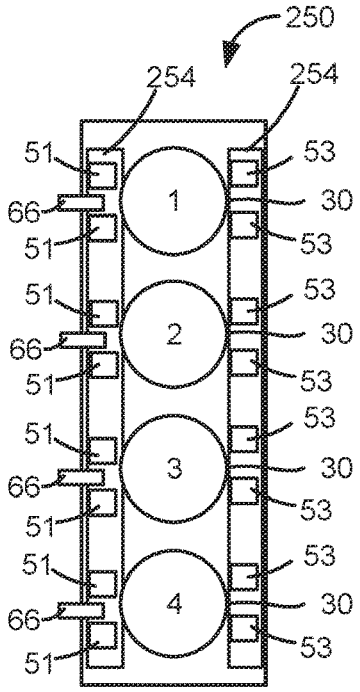
FIG. 2B is a schematic diagram of a four cylinder engine with a single cylinder bank.
Figure 3:
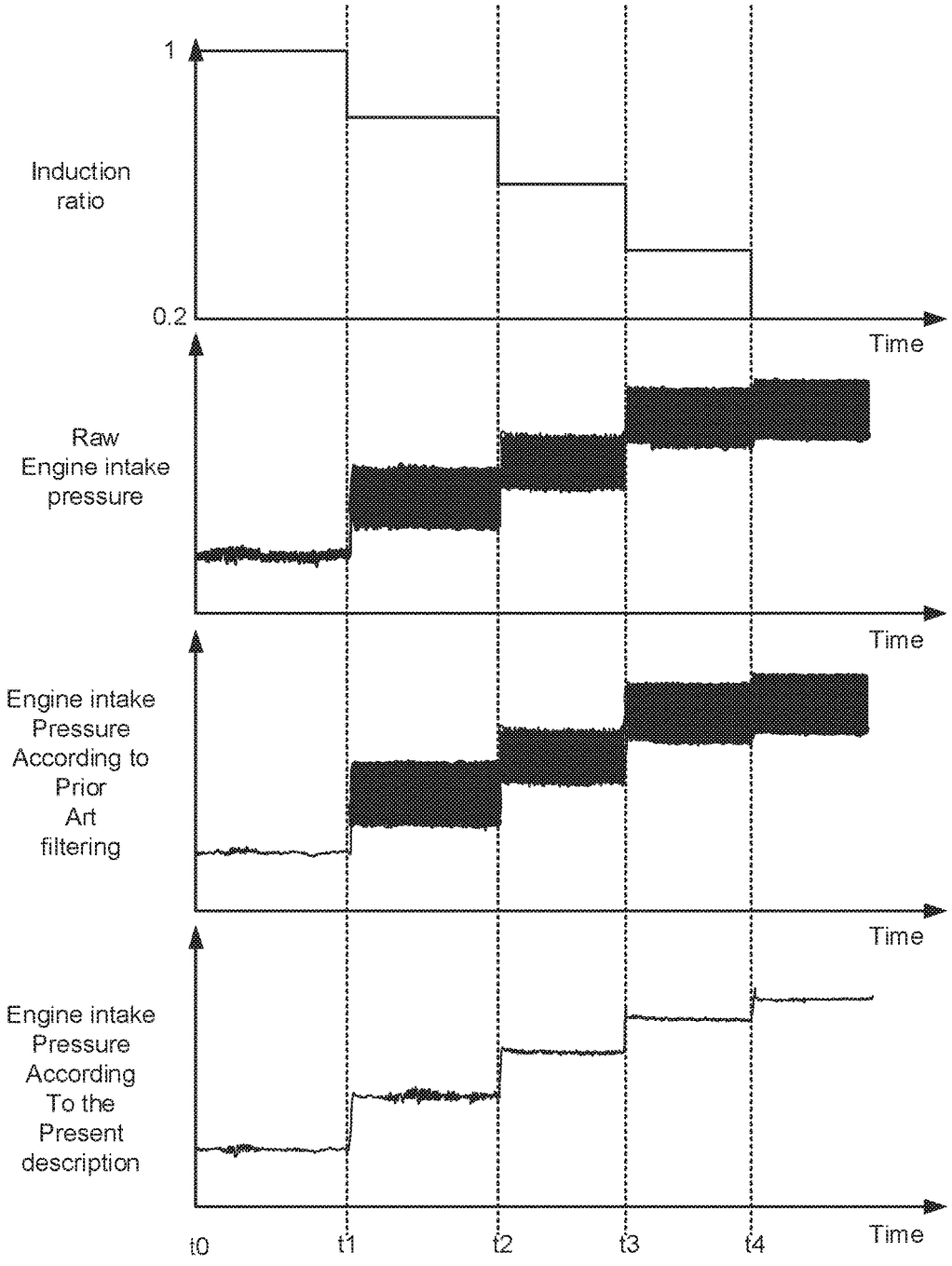
FIG. 3 shows an engine signal that is filtered according to the prior art and according to the present description.
Figure 4:
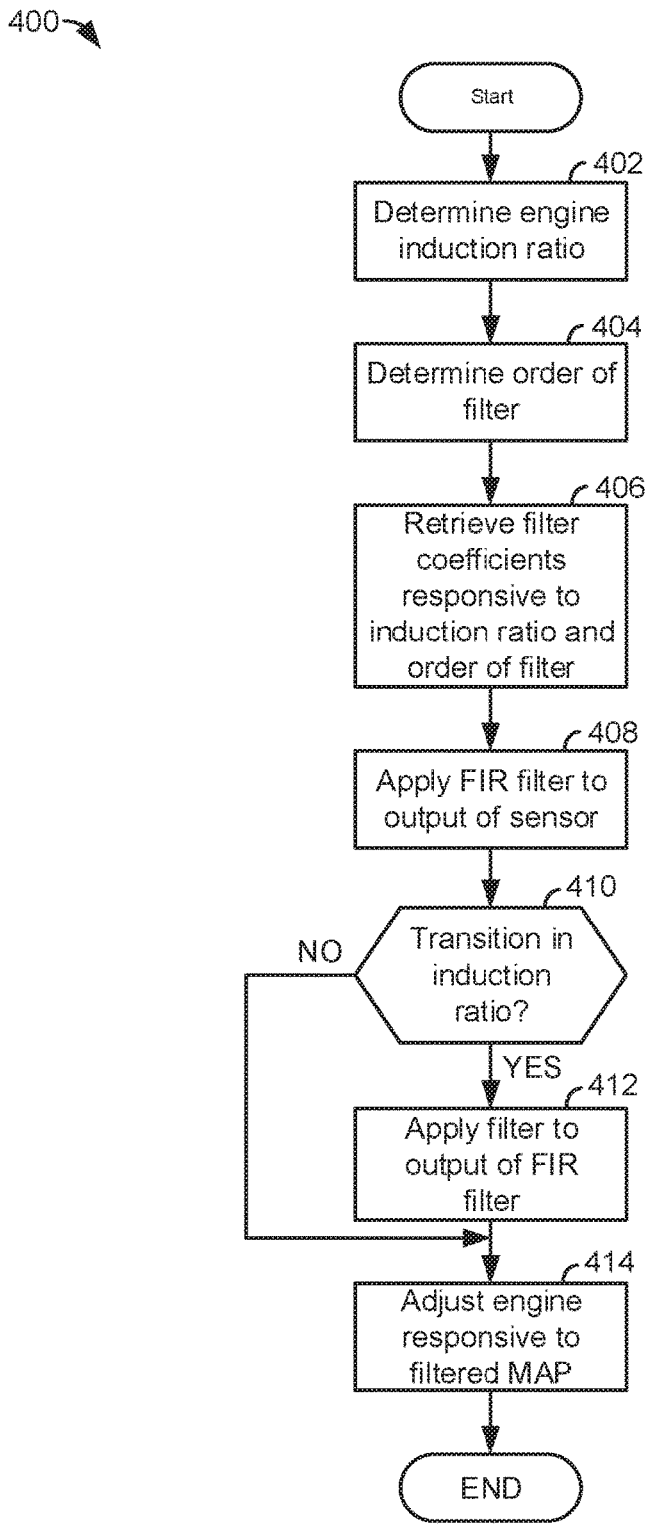
FIG. 4 shows a flow chart of a method to filter engine signals.

The present description is related to filtering signals from an engine and controlling the engine responsive to the filtered signals. An engine that includes cylinders that may be selectively deactivated is shown in FIG. 1. FIGS. 2A and 2B show example configurations for the engine described in FIG. 1. FIG. 3 shows an example sequence where engine induction ratio is changed and two different types of filters are applied to signals output from an engine sensor. An example method for processing a signal and controlling an engine responsive to the processed signal is shown in FIG. 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40.

Combustion chamber 30 is shown communicating with intake manifold 44 and exhaust manifold 48 via respective intake valve 52 and exhaust valve 54. Exhaust valve may be operated by a variable exhaust valve operator 53, which may be actuated mechanically, electrically, hydraulically, or by a combination of the same. For example, the exhaust valve actuators may be of the type described in U.S. Patent Publication 2014/0303873 and U.S. Pat. Nos. 6,321,704; 6,273,039; and 7,458,345, which are hereby fully incorporated for all intents and purposes. Exhaust valve 54 may be held closed during an entire engine cycle via variable exhaust valve operator 53. Further, exhaust valve operator may open exhaust 54 valves synchronously or asynchronously with crankshaft 40. The position of exhaust valve 54 may be determined by exhaust valve position sensor 57. Intake valve 52 is opened and closed via intake valve operator 51, which may be of the same type as exhaust valve operator 53. The position of intake valve 52 may be determined by intake valve position sensor 59. Intake valve 52 may be held closed during an entire engine cycle via variable intake valve actuator 51 to deactivate an engine cylinder (e.g., no combustion occurs in the cylinder for at least an engine cycle when a cylinder is deactivated). In one example, intake valve 52 and exhaust valve 54 are held closed and fuel is not injected to cylinder 30 when cylinder 30 is deactivated. Other engine cylinders may be activated while cylinder 30 is deactivated.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system 175. In addition, intake manifold 44 is shown communicating with optional electronic throttle 62 (e.g., a butterfly valve) which adjusts a position of throttle plate 64 to control air flow from air filter 43 and air intake 42 to intake manifold 44. Throttle 62 regulates air flow from air filter 43 in engine air intake 42 to intake manifold 44. In one example, a high pressure, dual stage, fuel system may be used to generate higher fuel pressures. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human driver 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; brake pedal position from brake pedal position sensor 154 when human driver 132 applies brake pedal 150; a turbocharger wastegate position sensor 156 (when present), alternatively sensor 156 may be an exhaust pressure sensor that may be position in an exhaust manifold; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined. User interface 155, which may be referred to as a display or panel, allows vehicle occupants to request vehicle mode (e.g., economy/standard) and receive requests or diagnostic information from controller 12.

In some examples, the engine may be coupled to an electric motor/battery system in a hybrid vehicle. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2A, an example multi-cylinder engine that includes two cylinder banks is shown. The engine includes cylinders and associated components as shown in FIG. 1. Engine 10 includes eight cylinders 30. Each of the eight cylinders is numbered and the numbers of the cylinders are included within the cylinders. Fuel injectors 66 selectively supply fuel to each of the cylinders that are activated (e.g., combusting fuel during a cycle of the engine). Cylinders 1-8 may be selectively deactivated to improve engine fuel economy when less than the engine's full torque capacity is requested. For example, cylinders 2, 3, 5, and 8 may be deactivated during an engine cycle (e.g., two revolutions for a four stroke engine) and may be deactivated for a plurality of engine cycles while engine speed and load are constant or very slightly. During a different engine cycle, a second fixed pattern of cylinders 1, 4, 6, and 7 may be deactivated. Further, other patterns of cylinders may be selectively deactivated based on vehicle operating conditions (e.g., engine speed and load). Additionally, engine cylinders may be deactivated such that a fixed pattern of cylinders is not deactivated over a plurality of engine cycles. Rather, cylinders that are deactivated may change from one engine cycle to the next engine cycle.

Each cylinder bank 202 and 204 includes variable valve actuators 53 for activating and deactivating intake valves. The variable valve actuators may be operated via camshafts 254. Intake valves are held in a closed position when deactivated. Further, each cylinder includes variable exhaust valve operators 53 for selectively activating and deactivating exhaust valves. An engine cylinder may be deactivated by ceasing fuel flow to the cylinder and holding its intake and exhaust valves closed over an entire engine cycle. An engine cylinder may be activated by starting to open and close exhaust valves and intake valves during a cycle of the engine while fuel is delivered to the cylinder. Engine 10 includes a first cylinder bank 204, which includes four cylinders 1, 2, 3, and 4. Engine 10 also includes a second cylinder bank 202, which includes four cylinders 5, 6, 7, and 8. Cylinders of each bank may be active or deactivated during a cycle of the engine.

Referring now to FIG. 2B, an example multi-cylinder engine that includes one cylinder bank is shown. The engine includes cylinders and associated components as shown in FIG. 1. Engine 10 includes four cylinders 210. Each of the four cylinders is numbered and the numbers of the cylinders are included within the cylinders. Fuel injectors 66 selectively supply fuel to each of the cylinders that are activated (e.g., combusting fuel during a cycle of the engine with intake and exhaust valves opening and closing during a cycle of the cylinder that is active). Cylinders 1-4 may be selectively deactivated (e.g., not combusting fuel during a cycle of the engine with intake and exhaust valves held closed over an entire cycle of the cylinder being deactivated) to improve engine fuel economy when less than the engine's full torque capacity is requested. For example, cylinders 2 and 3 (e.g., a fixed pattern of deactivated cylinders) may be deactivated during a plurality of engine cycles (e.g., two revolutions for a four stroke engine). During a different engine cycle, a second fixed pattern cylinders 1 and 4 may be deactivated over a plurality of engine cycles. Further, other patterns of cylinders may be selectively deactivated based on vehicle operating conditions. Additionally, engine cylinders may be deactivated such that a fixed pattern of cylinders is not deactivated over a plurality of engine cycles. Rather, cylinders that are deactivated may change from one engine cycle to the next engine cycle. In this way, the deactivated engine cylinders may rotate or change from one engine cycle to the next engine cycle.

Engine 10 includes a single cylinder bank 250, which includes four cylinders 1-4. Cylinders of the single bank may be active or deactivated during a cycle of the engine. Cylinder bank 250 includes variable intake valve actuators 51 for operating intake valves. Further, each cylinder includes variable exhaust valve operators 53 for selectively activating and deactivating exhaust valves. The variable valve actuators may be operated via camshafts 254. An engine cylinder may be deactivated by ceasing fuel flow to the cylinder and holding its intake and exhaust valves closed over an entire engine cycle. The engine cylinder may be activated by starting to open and close exhaust valves and intake valves during a cycle of the engine while fuel is delivered to the cylinder.

The system of FIGS. 1-2B provides for an engine system, comprising: an engine including one or more cylinder valve deactivating mechanisms; a sensor coupled to the engine; an actuator coupled to the engine; a controller including executable instructions stored in non-transitory memory to selectively deactivate one or more engine cylinders and adjust coefficients of a finite impulse response filter applied to a signal generated via the sensor, instructions to apply a second filter to output of the finite impulse response filter in response to a change of engine induction ratio, and instructions to adjust the actuator responsive to output of the finite impulse response filter and output of the second filter. The engine system further comprises additional executable instructions to adjust the coefficients via values stored in a table or matrix in memory of the controller. The engine system includes where the actuator is a fuel injector. The engine system includes where the actuator is an engine throttle. The engine system includes where the second filter is a low pass filter. The engine system includes where the second filter is comprised of instructions stored in controller memory.

Referring now to FIG. 3, a prophetic sequence showing prior art signal filtering and signal filtering according to the present description is shown. The plots are aligned in time and occur at a same time. The vertical lines at t0-t4 indicate times of interest during the sequence. The signal filtering shown in the present sequence may be provided via the method of FIG. 4 in cooperation with the system of FIGS. 1-2B.

The first plot from the top of FIG. 3 is a plot of engine induction ratio versus time. The vertical axis represents engine induction ratio and the engine induction ratio increases in the direction of the vertical axis arrow. The horizontal axis represents time and time increases from the left side of the figure to the right side of the figure.

The second plot from the top of FIG. 3 is a plot of a raw (e.g., unfiltered) engine intake manifold pressure versus time. The vertical axis represents engine intake manifold pressure and the engine intake manifold pressure increases in the direction of the vertical axis arrow. The horizontal axis represents time and time increases from the left side of the figure to the right side of the figure.

The second plot from the top of FIG. 3 is a plot of a raw (e.g., unfiltered) engine intake manifold pressure versus time. The vertical axis represents engine intake manifold pressure and the engine intake manifold pressure increases in the direction of the vertical axis arrow. The horizontal axis represents time and time increases from the left side of the figure to the right side of the figure.

The third plot from the top of FIG. 3 is a plot of engine intake manifold pressure filtered according to a prior art method (e.g., first order low pass filter) versus time. In other words, the third plot shows the output of a prior art filtering method that filters the raw signal shown in the second plot. The vertical axis represents filtered engine intake manifold pressure and the filtered engine intake manifold pressure increases in the direction of the vertical axis arrow. The horizontal axis represents time and time increases from the left side of the figure to the right side of the figure.

The fourth plot from the top of FIG. 3 is a plot of engine intake manifold pressure filtered according to the present description (e.g., a finite impulse response (FIR) filter with adjustable coefficients) versus time. In other words, the fourth plot shows the output of a filter according to the present description that filters the raw signal shown in the second plot. The vertical axis represents filtered engine intake manifold pressure and the filtered engine intake manifold pressure increases in the direction of the vertical axis arrow. The horizontal axis represents time and time increases from the left side of the figure to the right side of the figure.

The scaling of the engine intake manifold pressures for the second, third, and fourth plots is equivalent. Thus, the scaling and range of vertical axes of the second, third, and fourth plots is equivalent.

At time t0, the engine induction ratio is a value of one, which indicates all engine cylinders are active. The engine is combusting air and fuel in all cylinders (not shown). The raw engine intake manifold pressure signal is at a lower level and both the prior art filtering method and the filtering according to the present description are at lower levels.

Between time t0 and time t1, the engine operating with all its cylinders being active (e.g., combusting air and fuel). The raw engine intake manifold pressure has a small standard deviation. The output of the prior art filtering method smooths the raw engine intake manifold pressure signal and provides a filtered output that has an even lower standard deviation. The output of the filter according to the present description likewise provides a smooth engine intake manifold pressure.

At time t1, the engine induction ratio is reduced responsive to engine operating conditions (not shown). The raw engine intake manifold pressure is increased when the induction ratio is decreased so that the engine may supply a nearly constant amount of torque. The engine intake manifold pressure may be increased via opening the engine throttle (not shown). The magnitude of the output of the prior art filtering method increases in response to the raw engine intake manifold pressure increase. The magnitude of the output of the filter according to the present description also increases in response to the increase in raw engine intake manifold pressure. Coefficients for the filter according to the present description are adjusted responsive to the change in engine induction ratio.

Between time t1 and time t2, the engine is operating with fewer than all of its cylinders being active (e.g., combusting air and fuel). The raw engine intake manifold pressure standard deviation has increased significantly. The output of the prior art filtering method has nearly the same standard deviation as the raw engine intake manifold pressure signal. The prior art filter output magnitude varies such that engine air-fuel ratio control based on its output may vary more than is desired. The magnitude of the output of the filter according to the present description provides a smooth engine intake manifold pressure from which engine air-fuel ratio may be more precisely controlled.

At time t2, the engine induction ratio is reduced again responsive to engine operating conditions (not shown). The raw engine intake manifold pressure is increased further when the induction ratio is decreased so that the engine may supply a nearly constant amount of torque. The magnitude of the output of the prior art filtering method increases in response to the raw engine intake manifold pressure increase. The magnitude of the output of the filter according to the present description also increases in response to the increase in raw engine intake manifold pressure. Coefficients for the filter according to the present description are adjusted a second time responsive to the change in engine induction ratio.

Between time t2 and time t3, the engine is operating with even fewer than all of its cylinders being active (e.g., combusting air and fuel). The raw engine intake manifold pressure standard deviation remains large. The standard deviation of the output of the prior art filtering method also remains large. However, the output of the filter according to the present description provides a smooth engine intake manifold pressure from which engine air-fuel ratio may be more precisely controlled. In other words, the standard deviation of the intake manifold pressure output from the filter according to the present description is less than the standard deviation of the intake manifold pressure according to the prior art method. This may allow an engine controller to provide a smoother engine air-fuel ratio that exhibits less noise, thereby improving engine emissions.

At time t3, the engine induction ratio is reduced a third time responsive to engine operating conditions (not shown). The raw engine intake manifold pressure is increased further when the induction ratio is decreased so that the engine may supply a nearly constant amount of torque. The magnitude of the output of the prior art filtering method increases in response to the raw engine intake manifold pressure increase. The magnitude of the output of the filter according to the present description also increases in response to the increase in raw engine intake manifold pressure. Coefficients for the filter according to the present description are adjusted a third time responsive to the change in engine induction ratio.

Between time t3 and time t4, the engine is operating with even fewer than all of its cylinders being active (e.g., combusting air and fuel). The raw engine intake manifold pressure standard deviation remains large. The standard deviation of the output of the prior art filtering method also remains large. However, the output of the filter according to the present description provides a smooth engine intake manifold pressure from which engine air-fuel ratio may be more precisely controlled. In other words, the standard deviation of the intake manifold pressure output from the filter according to the present description is less than the standard deviation of the intake manifold pressure according to the prior art method. This may allow an engine controller to provide a smoother engine air-fuel ratio that exhibits less noise, thereby improving engine emissions.

At time t4, the engine induction ratio is reduced a fourth time responsive to engine operating conditions (not shown). The raw engine intake manifold pressure is increased further when the induction ratio is decreased so that the engine may supply a nearly constant amount of torque. The magnitude of the output of the prior art filtering method increases in response to the raw engine intake manifold pressure increase. The magnitude of the output of the filter according to the present description also increases in response to the increase in raw engine intake manifold pressure. Coefficients for the filter according to the present description are adjusted a fourth time responsive to the change in engine induction ratio.

After time t4, the engine is operating with even fewer than all of its cylinders being active (e.g., combusting air and fuel). The raw engine intake manifold pressure standard deviation remains large. The standard deviation of the output of the prior art filtering method also remains large. However, the output of the filter according to the present description provides a smooth engine intake manifold pressure from which engine air-fuel ratio may be more precisely controlled.

In this way, a raw signal output from an engine sensor may be filtered via a finite impulse response filter and the filter's coefficients may be adjusted each time to tailor filter output responsive to the engine induction ratio and frequencies in the output of the sensor that may be related to the engine induction ratio.

Referring now to FIG. 4, a flow chart describing a method for operating an engine is shown. The method may include filtering output of an engine sensor responsive to an engine induction ratio, and coefficients of a filter modifying output of the engine sensor may be adjusted responsive to the engine induction ratio. Adjusting the coefficients may improve filter response and characteristics (e.g., standard deviation) of signals output from the filter. The method of FIG. 4 may be incorporated into and may cooperate with the system of FIGS. 1-2B. Further, at least portions of the method of FIG. 4 may be incorporated as executable instructions stored in non-transitory memory while other portions of the method may be performed via a controller transforming operating states of devices and actuators in the physical world. The vehicle's engine is rotating and combusting air and fuel in at least one cylinder while method 400 is active.

At 402, method 400 determines an engine induction ratio. In one example, the engine induction ratio may be determined via the following equation:

$$i_r = \frac{n}{d}$$

where $i_r$ is the engine induction ratio, n is the actual total number of active cylinders (e.g., cylinders combusting air and fuel), d is the actual total number of engine cylinders. For example, if the engine has eight cylinders and three cylinders fire during an engine cycle, the engine induction ratio for that engine cycle is 0.375. The engine induction ratio may be changed responsive to engine speed and load as well as other engine operating conditions. Method 400 proceeds to 404.

At 404, method 400 determines an order of a finite impulse response filter or an infinite impulse response (IIR) filter. The order of the filter determines the rate of attenuation of frequencies in the filtered signal. The filter has a maximum gain of one and frequencies that are attenuated are determined via location of zeros of the filter. The rate of attenuation for undesired frequencies passing into the filter is increased as the order of the filter increases. However, the computational load of determining output of the filter increases with the order of the filter. The order of the filter may be a compromise of filter output and computational load to filter a signal. In one example, the order of the filter is predetermined and the number of filter coefficients is determined from the order of the filter. The order of the filter may depend on characteristics of the engine and sensor output. For example, a second order FIR filter may be applied to output of a pressure sensor coupled to an eight cylinder engine. Whereas, a first order FIR filter may be applied to output of a pressure sensor coupled to a four cylinder engine. The order of the FIR filter may be empirically determined and stored to controller memory. The order of the filter may be retrieved from memory via referencing memory according to the vehicle configuration. Method 400 proceeds to 406.

At 406, method 400 retrieves FIR or IIR filter coefficients from controller memory. In one example, FIR filter coefficients may be empirically determined based on frequencies in the raw sensor output signal that may be undesirable. The filter coefficients may be selected to attenuate undesirable frequencies, and the undesirable frequencies may change according to the present engine induction ratio. In one example, a table or matrix of FIR coefficients is stored to controller memory. The dimension of the table or matrix may be N rows by M columns. The value of N is the maximum order of a FIR filter obtained from the table. For example, if the maximum FIR filter order is one (a first order filter), the value of N=2, where one table entry for each engine induction ratio is reserved for a $b_0$ coefficient and one table entry for each engine induction ratio is reserved for a $b_1$ coefficient. M is the actual total number of available engine induction ratios. Note that the order of the FIR filter may be adjusted via choosing appropriate filter coefficients as zero. For example, if N=8, then the order of the FIR filter may be adjustable between 0 and 7.

Thus, the matrix or table dimensions are based on the filter order and the engine induction ratios. Filter coefficients for engine induction ratios not having specific entries in the table or matrix may be interpolated or extrapolated. The empirically determined values in the table or matrix may be referenced via the engine induction ratio and the order of the filter. In some examples, the order of the filter may be fixed and the table or matrix may be referenced using only the engine induction ratio. Method 400 retrieves the filter coefficients and proceeds to 408.

Figure 5:
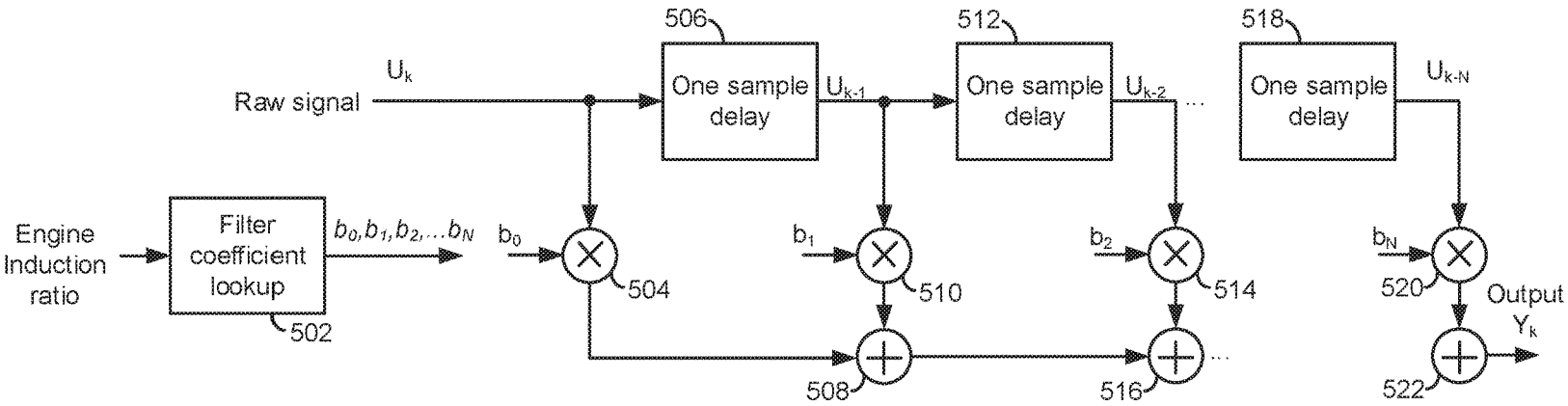
FIG. 5 is a graphic representation of a finite impulse response filter.

At 408, a sensor coupled to the engine (e.g., a MAP sensor, MAF sensor, engine speed sensor, wastegate position sensor, or cam position sensor) is sampled at a predetermined frequency and the raw output of the sensor is input to the FIR or IIR filter. Said another way, the FIR or IIR filter is applied to output of an engine sensor. In one example, the FIR filter may be implemented according to the following equation:

$$y_k = \sum_{i=0}^{N} b_i u_{k-i}$$

where $y_k$ is FIR filter output, k is the time step, i is an indexing variable, b is a FIR filter coefficient, N is the order of the filter, and $u_{k-i}$ are raw engine sensor values take at defined sample intervals. The filter may be graphically expressed as is shown in FIG. 5. Method 400 proceeds to 410 after filtering input from the engine sensor.

At 410, method 400 judges if there is presently a transition in the engine induction ratio. For example, if the engine induction ration is presently or has just changed from a value of 0.8 to a value of 0.5, the answer is yes and method 400 proceeds to 412. Otherwise, the answer is no and method 400 proceeds to 414. Method 400 makes an assessment of engine induction ratio so that output of the filter from step 408 this execution of method 400 may be smoothed with output of the filter from step 408 the next execution of method 400. In some examples, method 400 may execute once each time the engine sensor is sampled.

At 412, a second filter may be applied to output from the FIR or IIR filter described at 408. The second filter may smooth discontinuities that may result from changes in filter coefficients and changes in sensor output that may be related to changing engine induction ratio. In one example, the second filter may be another FIR filter. In another example, the second filter may be a first order low pass filter. Method 400 applies the second filter to output of the FIR or IIR filter and filtered engine intake manifold pressure is made available for calculating other variable within the controller. Method 400 proceeds to 414.

At 414, method 400 adjusts one or more engine actuators responsive to output of the FIR or IIR filter or output of the second filter. Method 400 may adjust the one or more engine actuators responsive to output of the second filter if an engine induction ratio change is in progress or within a predetermined actual number of engine sensor samples after a change in the engine induction ratio. For example, if an engine induction ratio change is in progress, method 400 may adjust engine actuators responsive to the latest value output from the second filter and output from the second filter the next five times method 400 is executed after each time the engine sensor is sampled. However, if the engine induction ratio has not changed and a predetermined actual total number of samples of the engine sensor have been performed since the most recent engine induction ratio change, then method 400 may adjust engine actuator responsive to output of the FIR filter.

Method 400 adjusts actuators having positions or states that are based on filtered output of the engine sensor. In one example, method 400 adjusts fuel injector pulse widths responsive to filtered engine sensor output (e.g., output from the FIR or IIR filter or the second filter). For example, if the sensor is a MAP sensor, an amount of fuel injected via a fuel injector may be adjusted responsive to an engine air amount (e.g., air flow through the engine), where the engine air amount is estimated from filtered MAP sensor output and the ideal gas law. In another example, method 400 adjusts a position of an EGR valve and a throttle responsive to filtered output of the MAP sensor. In still other examples, engine camshaft timing may be adjusted responsive to filtered MAP sensor output. Method 400 proceeds to exit after adjusting engine actuators responsive to filtered output of the engine sensor.

Thus, the method of FIG. 4 provides for an engine operating method, comprising: receiving a signal to a controller; adjusting coefficients of a finite impulse response filter responsive to an engine induction ratio; filtering the signal (MAP, engine speed, engine air flow, or cam timing signals) via the finite impulse response filter; and adjusting one or more actuators responsive to the filtered signal. The method includes where the coefficients are determined via referencing a matrix or table of predetermined coefficients responsive to the engine induction ratio and order of the finite impulse response filter. The method further comprises interpolating between entries in the matrix. The method includes where the actuator is a fuel injector. The method includes where the actuator is an engine camshaft. The method includes where the actuator is an engine throttle. The method includes where the engine induction ratio is an actual total number of cylinders combusting air and fuel in a cylinder cycle divided by an actual total number of engine cylinders.

The method of FIG. 4 also provides for an engine operating method, comprising: receiving a signal to a controller; retrieving coefficients of a finite impulse response filter from a table or matrix in memory of the controller via referencing the table or matrix via engine induction ratio; applying the coefficients to the finite impulse response filter; filtering the signal via the finite impulse response filter; and adjusting one or actuators responsive to the filtered signal. The method includes where the matrix is an N×M matrix. The method includes where N is an actual total order of the finite impulse response filter. The method includes where M is an engine induction ratio. The method includes where the engine induction ratio is adjusted responsive to engine operating conditions. The method includes where the engine induction ratio increases with engine load. The method further comprises filtering the signal via a second filter in response to a change in the engine induction ratio.

Referring now to FIG. 5, a graphic example of a FIR filter having coefficient that are adjusted responsive to engine induction ratio is shown. A raw unfiltered output from an engine sensor is input to the FIR filter and it is indicated as $U_k$. The engine induction ratio references lookup table or matrix 502 and the table outputs coefficients $b_0, b_1, \ldots b_N$. The respective coefficients are multiplied by present and past values of the raw engine sensor output at multiplication blocks 504, 510, 514, and 520. Blocks 506, 512, and 518 each represent a delay of one sample. Outputs from the multiplication blocks are then added at summation blocks 508, 516, and 522. Further, output of summation block 508 is added to output of multiplication block 514 and summing block 516. The output of the FIR filter is indicated as $Y_k$ and it is output of summing block 522.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage. Further, the engine may be turbocharged or supercharged.

The invention claimed is:

1. An engine operating method, comprising:

receiving a signal to a controller;

adjusting coefficients of a finite impulse response filter responsive to an engine induction ratio;

filtering the signal via the finite impulse response filter;

filtering output of the finite impulse response filter via a low pass filter in response to a change in the engine induction ratio;

not filtering output of the finite impulse response filter via the low pass filter in response to an absence of the change in engine induction ratio; and adjusting one or more actuators responsive to the filtered signal.

2. The method of claim 1, where the coefficients are determined via referencing a matrix or table of predetermined coefficients responsive to the engine induction ratio and an order of the finite impulse response filter.

3. The method of claim 2, further comprising interpolating between entries in the matrix.

4. The method of claim 1, where an actuator of the one or more actuators is a fuel injector.

5. The method of claim 1, where an actuator of the one or more actuators is an engine camshaft.

6. The method of claim 1, where an actuator of the one or more actuators is an engine throttle, and where the signal is provided via a manifold absolute pressure sensor, an air mass sensor, an engine speed sensor, a cam position sensor, an exhaust manifold pressure sensor, or a wastegate position sensor.

7. The method of claim 1, where the engine induction ratio is an actual total number of cylinders combusting air and fuel in a cylinder cycle divided by an actual total number of engine cylinders.

8. An engine operating method, comprising:

receiving a signal to a controller;

retrieving coefficients of a finite impulse response filter from a table or matrix in memory of the controller via referencing the table or matrix via an engine induction ratio;

applying the coefficients to the finite impulse response filter;

filtering the signal via the finite impulse response filter;

filtering output of the finite impulse response filter via a low pass filter in response to a change in the engine induction ratio;

not filtering output of the finite impulse response filter via the low pass filter in response to an absence of the change in the engine induction ratio; and adjusting one or more actuators responsive to the filtered signal.

9. The method of claim 8, where the matrix is an N×M matrix.

10. The method of claim 9, where N is an order of the finite impulse response filter.

11. The method of claim 9, where M is a number of available engine induction ratios.

12. The method of claim 11, where the engine induction ratio is adjusted responsive to engine operating conditions.

13. The method of claim 12, where the engine induction ratio increases with engine load.

14. The method of claim 8, further comprising further filtering the signal via a second filter in response to the change in the engine induction ratio.

15. An engine system, comprising:

an engine including one or more cylinder valve deactivating mechanisms;

a sensor coupled to the engine;

an actuator coupled to the engine;

a controller including executable instructions stored in non-transitory memory to selectively deactivate one or more engine cylinders and adjust coefficients of a finite impulse response filter applied to a signal generated via the sensor, instructions to apply a second filter to output of the finite impulse response filter in response to a change of engine induction ratio, and instructions to adjust the actuator responsive to output of the finite impulse response filter and output of the second filter.

16. The engine system of claim 15, further comprising additional executable instructions to adjust the coefficients via values stored in a table or matrix in memory of the controller and to not apply the second filter to output of the finite impulse response filter in response to an absence of the change in engine induction ratio.

17. The engine system of claim 15, where the actuator is a fuel injector.

18. The engine system of claim 15, where the actuator is an engine throttle.

19. The engine system of claim 15, where the second filter is a low pass filter.

20. The engine system of claim 15, where the second filter is comprised of instructions stored in controller memory.

* * * * *